United States Patent [19]

Dale et al.

[11] Patent Number: 5,059,137

[45] Date of Patent: Oct. 22, 1991

[54] INSULATION DISPLACEMENT CONTACT FOR FLAT CABLE

[75] Inventors: James L. Dale, Lawrenceville; Vernon R. Miller, Atlanta, both of Ga.

[73] Assignee: AMP Incorporated, Harrisburg, Pa.

[21] Appl. No.: 571,960

[22] Filed: Aug. 23, 1990

[51] Int. Cl.[5] ..... H01R 4/24

[52] U.S. Cl. ..... 439/395

[58] Field of Search ..... 439/389–425

[56] References Cited

U.S. PATENT DOCUMENTS

| | | | |
|---|---|---|---|
| 4,077,695 | 3/1978 | Bakermans | 339/176 MF |
| 4,367,004 | 1/1983 | Fujiura et al. | 439/396 |
| 4,460,228 | 7/1984 | Lane et al. | 339/99 R |
| 4,472,014 | 9/1984 | Goodman et al. | 439/395 |
| 4,527,852 | 7/1985 | Dechelette | 339/97 P |
| 4,691,977 | 9/1987 | Marzili et al. | 439/404 |
| 4,743,208 | 5/1988 | Weisenberger | 439/398 |
| 4,861,278 | 8/1989 | McBride et al. | 439/395 |

*Primary Examiner*—Joseph H. McGlynn

*Attorney, Agent, or Firm*—William B. Noll

[57] ABSTRACT

An electrical connector assembly in the form of a cable tap for use with a flat cable having wires of different sizes includes insulation penetrating terminals having sharp points on opposite sides of an insulation displacement slot. These sharp points are spaced apart and configured to reduce the tendency of the slots to diverge prior to engagement with the wires. Each slotted plate has inner and outer sloping edges with a slope of the inner edge relative to the center line of the slot being less than the slope of the outer knife edge so as to reduce the resultant force tending open the slot prior to engagement of the terminals with the wires. Additonally, the sharp points of a given terminal are spaced apart a lateral distance of from 1 to 1.5 times the diameter of the wire to be terminated therebetween. The terminals are positioned within the housing which is matable to a clamp having cylindrical grooves adapted to closely fit the curved outer cylindrical crest surrounding the ground wires in the cable. Terminals are insertable through apertures in a cable clamp penetrating the insulation and intersecting the individual wires.

6 Claims, 5 Drawing Sheets

INSULATION DISPLACEMENT CONTACT FOR FLAT CABLE

BACKGROUND OF THE INVENTION

1. Field of the Invention

This invention is directed to an insulation displacement contact intended for use in making an electrical termination to round conductor and is more particularly related to two insulation displacement contacts especially adapted for making an electrical termination to wires of different sizes in the same hybrid flat cable.

2. Description of the Prior Art

Insulation displacement contacts, or slotted plate contacts have been reliably used to established electrical connection with both discrete conductors and conductors employed in a flat cable. A parallel plate configuration having a dual slot feature, in which aligned slots are formed in two parallel plates is often employed with discrete wires. These dual slots may both be electrical contact slots or one may function as an insulation support or strain relief. Such dual slot insulation displacement contacts can enhance electric performance if one of two primary electrical contact slots undergoes degradation in performance, because the other provides a redundant contact. An insulation strain relief function, which can be provided by one slot, can prevent mechanical forces from being transferred to the active electrical contact.

When insulation displacement slotted contacts are employed with flat cable, dual slotted configurations or parallel plate configurations are generally not employed. Typically, a single slot feature is employed in a connector used to form an insulation displacement mass termination of flat or ribbon cable. These single slot contacts typically have sharp or pointed beam tips intended to penetrate cable jackets and allow entry of the conductors into the slot. U.S. Pat. No. 4,460,228 discloses one such electrical connector intended for establishing an insulation displacement termination with a plurality of conductors in a flat cable. Other such configurations are shown in U.S. Pat. No. 4,077,695 and U.S. Pat. No. 4,691,977. These patents are merely representative of a number of different configurations which employ sharp points on the tips of insulation beam contacts to penetrate the insulation in a flat cable.

A typical flat cable of the type with which these contacts are employed has a plurality of spaced apart round conductors, which are embedded in a laminated or extruded insulation web. Typically, the extruded flat cable configurations or ribbon cables, have an extrusion of substantially the same thickness encasing all of the conductors in the ribbon cable. Typically these conductors are the same size and are spaced apart by sufficient distance so that a flat section is formed in between the parallel wires and the insulation surrounding the wires forms a bulge or cylindrical crest around the embedded wires. With conventional sharp pointed insulation displacement contacts, the contacts are dimensioned such that the sharp points engage the flat web between the parallel cylindrical crests. The edges extending inwardly from the sharp points, and between the sharp points and the insulation displacement slot, displace or penetrate the insulation surrounding the conductors, which are funneled into the slot where the primary electrical connection is established. Such insulation displacement terminations have proven to be very successful for typical ribbon cables which employ relatively small signal conductors.

The sharp points used on insulation displacement terminals intended for use with flat cables have also been employed in certain applications in which insulation displacement terminals are intended for use with discrete wires. For example, U.S. Pat. No. 4,527,852 discloses an electrical connector employing a U-shaped insulation displacement terminal in which the insulation displacement slot tapers from a mouth to a pair of opposed teeth positioned so that they point in the general direction of the mouth and serve to initiate severing of the conductor coating. U.S. Pat. No. 4,743,208 discloses another insulation displacement terminal intended for use with discrete wires in which finger portions extend upwardly from the plate portions containing the insulation displacement slots so that the height of the slot is greater than would otherwise be provided in an insulation displacement terminal having a strap portion adjacent the wire receiving mouth of the terminal.

Although these insulation displacement terminal configurations have been reliably employed to establish electrical connection to discrete conductors and to flat cable using mass termination techniques, none of these insulation displacement terminals have been specifically adapted for use with a hybrid ribbon cable. A hybrid ribbon cable is defined as a cable having conductors of different sizes. For example, a hybrid ribbon cable has been proposed for use in house wiring in which twelve or fourteen gauge power conductors would be combined with twenty-four gauge signal conductors. If insulation displacement mass termination techniques are to be used to terminate such cables, the terminals terminating the power conductors must be larger than the terminals terminating the signal conductors. Prior art techniques, in which the insulation surrounding the conductors in a flat cable are initially penetrated by inclined edges defining a portion of the funnel shaped mouth of the insulation displacement slot, have proved unreliable in terminating these conductors. One problem that has been encountered is the displacement of the terminals themselves as they engage the insulation surrounding the conductors. FIG. 1 shows a prior art configuration in which the terminal arms are displaced, i.e. plastically deformed, by the insulation to the point that contact is not made with the conductor. Note that insulation remains between the conductor and terminal arms. Although this problem is especially significant with respect to the more fragile and flimsy small contacts used to terminate closely spliced signal conductors, the same problem can be encountered with the larger insulation displacement terminals intended for use in terminating relatively large power wires. The instant invention is especially adapted for terminating hybrid ribbon cables, but the terminals employed herein and the connector employed herein can also be used with discrete conductors. Simple and reliable termination which can be carried out in uncontrolled, field, applications is achieved by employing the terminals incorporating the subject matter of this invention.

SUMMARY OF THE INVENTION

The terminal comprising the preferred embodiment of this invention comprises an insulation displacement terminal having a slot formed in a plate with two members being defined on either side of the slot. A sharp point is defined at the end of each said member on either side of the slot. Of primary importance is the fact that the lateral spacing between the respective sharp points is between 1 and 1.5 times the diameter of the conductor to be terminated therebetween. In a preferred embodiment, inner and outer sloping edges are defined on either side of the sharp points on opposite sides of the insulation displacement slot. The slopes of the inner slot and the outer slot are different. The slope of the inner slot is less than the slope of the outer sloping edge, both taken relative to the center line of the slot. Thus, the force applied to said members on the opposite sides of the slots is reduced since the resultant force acting on the outer sloping edge during insertion is more nearly perpendicular to the slot than the resultant force acting on the inner sloping edge. Thus, the tendency of the two members on opposite sides of the slot to spread and plastically deform, as a result of the engagement of the insulation with the inner and outer sloping edge, is lessened so that the slot edges make a more reliable contact with the wire upon insertion of the wire into the slot.

The preferred embodiment of this invention employs such terminals in an electrical connector assembly intended for use with a plurality of wires in a flat cable which has insulation surrounding the wires in such a manner as to form cylindrical crests, concentric with the wires on the outer surface of the cable. The cable is held within a clamp having cylindrical grooves which conform generally to the shape of the cylindrical crests. The sharp points defined on the terminals are spaced apart by a distance less than the effective width of the grooves, and thus less than the effective width of the concentric cylindrical crests on the cable. That is, the sharp points engage the rounded surface of the cylindrical crests of the cable rather than engaging a flat web between wires. In this manner the sharp points engage the cylindrical crests of the cable in such a manner that the terminal is not spread apart unnecessarily prior to engagement with the wires in the cable.

An electrical connector assembly for use in terminating a hybrid ribbon cable in a field environment, includes a cable clamp for holding the cable with the conductors on appropriate center lines. Large power conductor insulation displacement terminals and relatively smaller signal terminals are positioned within an insulative housing which is attachable to the cable clamp. In order to minimize space constraints, signal conductors are closer together than the power conductors in such a hybrid ribbon cable. Therefore, the signal conductors must be significantly smaller than the power conductors. However, since the signal and power conductors lie in the same plane, the length of the signal conductors must be substantially the same as the length of the power conductors. This results in a very fragile, relatively easily deformed, signal terminal. The use of sharp points positioned on the exterior of the signal terminals, in combination with appropriately sloping inner and outer sloping edges, results in engagement between the sharp insulating piercing points and the corresponding cylindrical crests of the cable at a relatively steep angle. Thus, penetration of a common insulative web in the cable is initiated in such a manner as to reduce the tendency of the slot in the slotted plate to become enlarged prior to engagement with the small signal conductors.

BRIEF DESCRIPTION OF THE DRAWINGS

FIG. 10 is taken substantially along Section 10—10 in FIG. 9, and shows the engagement of the terminal with a bus bar.

DETAILED DESCRIPTION OF THE PREFERRED EMBODIMENT

Figure 1:
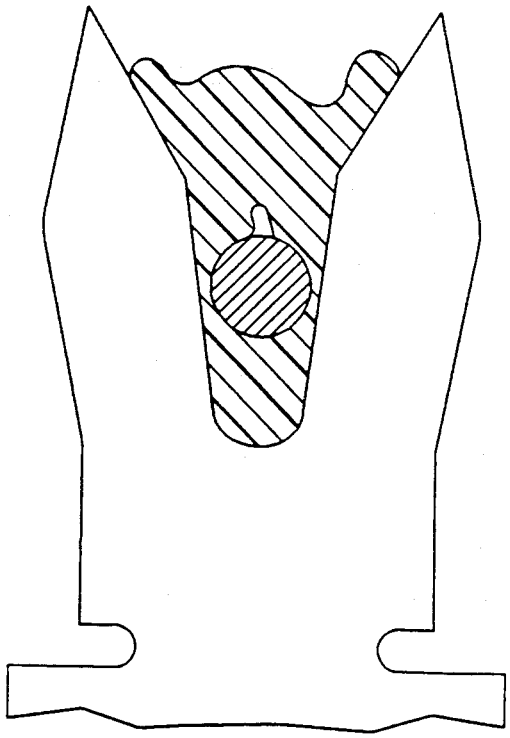
FIG. 1 is a view of a prior art insulation displacement slot having inclined edges which engage the cylindrical crest of a flat ribbon cable.

The electrical connector assembly comprising the preferred embodiment of this invention is intended for use in establishing insulation displacement contacts with a plurality of wires in a flat cable 2. The flat cable 2 comprises a hybrid ribbon cable having relatively larger wires 4 and relatively smaller wires 6. Hybrid ribbon cable 2 comprising the preferred embodiment of this invention can employ relatively larger wires 4 which are fourteen gauge or larger, whereas, the smaller wires can be twenty-four gauge wires. The hybrid cable of this type can employ a polyvinyl chloride insulating material 8 to surround the wires 4 and 6. In the preferred embodiment of this invention, the relatively larger wires 4 are also surrounded by a second inner insulative material. These insulated larger wires 4 and uninsulated smaller wires 6 are then surrounded by a relatively uniformly thick common insulative web 8. In the preferred embodiment of this invention, this insulative web 8 is extruded around both the larger wires 4 and the smaller wires 6. The dual insulation surrounding the relatively larger wires 4 is intended to provide a configuration very similar to double the insulated conventional Nonmetallic-Sheathed Cables used for residential electrical power distribution.

Figure 2:
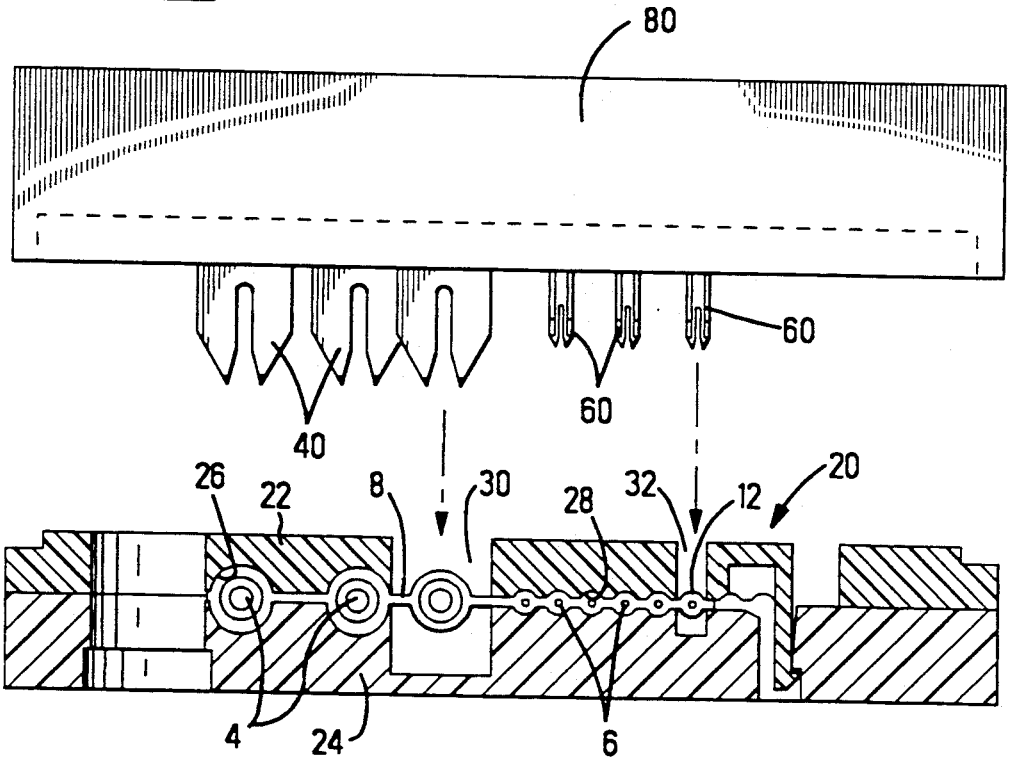
FIG. 2 is an exploded view of an electrical connector assembly taken along an irregular section including a cable clamp, power and signal insulation displacement terminals, a hybrid ribbon cable and a housing in which the terminals are positioned.
Figure 3:
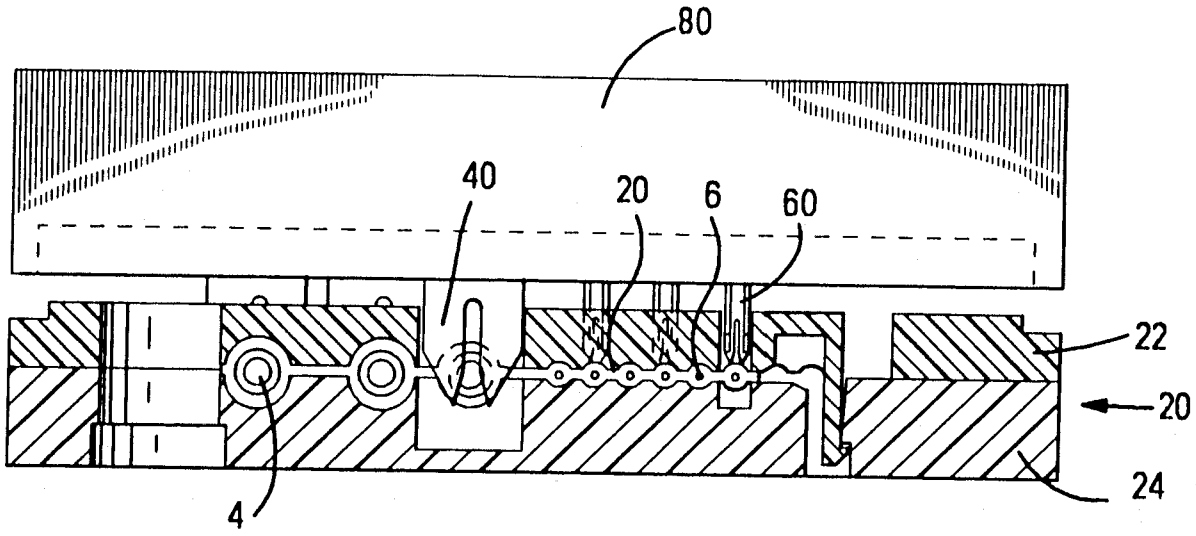
FIG. 3 is a view of the electrical connector assembly of FIG. 2, also taken along an irregular section, showing the initial engagement of the sharp points on the smaller terminals with a cylindrical crests of the insulation on the flat cable.
Figure 4:
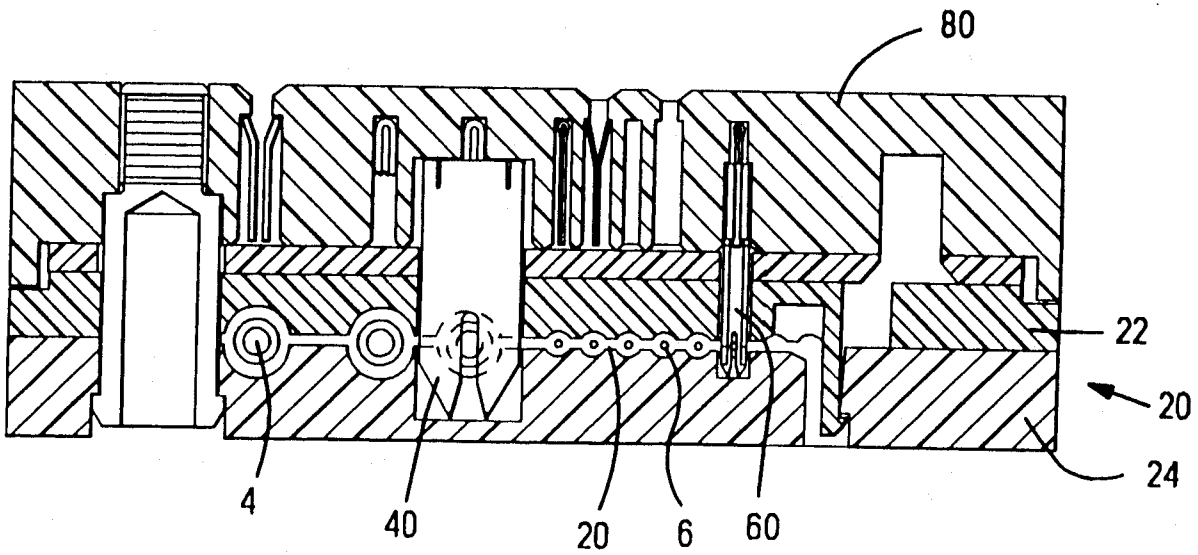
FIG. 4 is a view of the electrical connector assembly of FIGS. 2 and 3, also taken along an irregular section, showing a completed termination of both power and signal conductors by insulation displacement terminals.

The insulation surrounding the wires 4 and 6 forms cylindrical crests 10 and 12, each concentric with the wire on the outer surface of the cable. Thus, a ribbed configuration, specifically identifying the position of each wire is established. As shown in FIG. 2, the centerline spacing between adjacent smaller wires 6 is much less than the centerline spacing of adjacent relatively larger wires. The centerline spacing of the relatively larger wires is governed by the need to provide appropriate centerline spacing for conductors intended to carry fifteen to twenty amps. The current to be carried by the smaller wire 6 is intended merely for control purposes and the conductor spacing requirement is therefore much less. Since space is generally at a premium, a smaller cable is better, i.e. more economic. This is the reason for the close spacing between the relatively smaller wires 6. However, since this is a flat cable configuration, the axes of both the relatively larger wires 4 and the relatively smaller wires 6 lie within a common plane when the cable is in a flat configuration.

In the preferred embodiment of this invention the flat cable 2 is prepared for insulation displacement termination by first positioning cable 2 in cable clamp 20. Cable clamp 20 is formed of first and second matable clamp sections 22 and 24. Both of the two clamp sections 22 and 24 have first cylindrical grooves 26 conforming to the shape of the cylindrical crests 10 surrounding the relatively large wires 4. Each of the cable clamp sections 22 and 24 also have second cylindrical grooves 28 conforming to the contour of the second cylindrical crest 12 surrounding the relatively smaller wires 6. A hybrid flat cable 2 containing wires of different sizes can be positioned within clamp 20 and the cable 2 can be held in a flat configuration with the centerlines of all of the wires 4 and 6 being in the same plane for insulation displacement termination. The first cylindrical grooves 26 have substantially the same curvature as the corresponding first cylindrical crest 12 surrounding wires 4. The second cylindrical grooves 28 also have substantially the same curvature as the corresponding cylindrical crests 12 surrounding the relatively smaller wires 6. A plurality of first and second apertures 30 and 32 intersect each groove 26, 28 respectively. The width of the apertures 30 and 32 is less than the centerline spacing of adjacent wires so that only one aperture intersects each groove in clamp 20.

Figure 5:
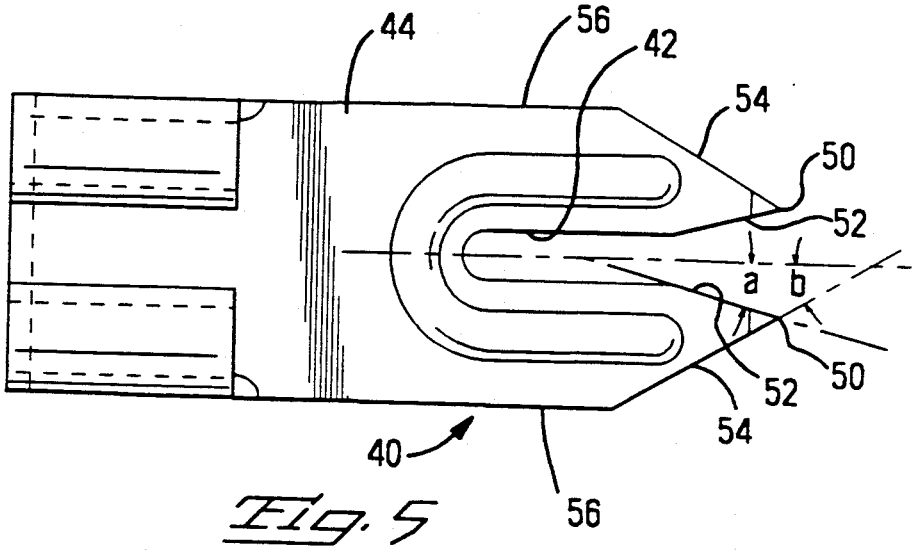
FIGS. 5–7 are views of a relatively larger power insulation displacement terminal employing the preferred embodiment of this invention.
Figure 6:
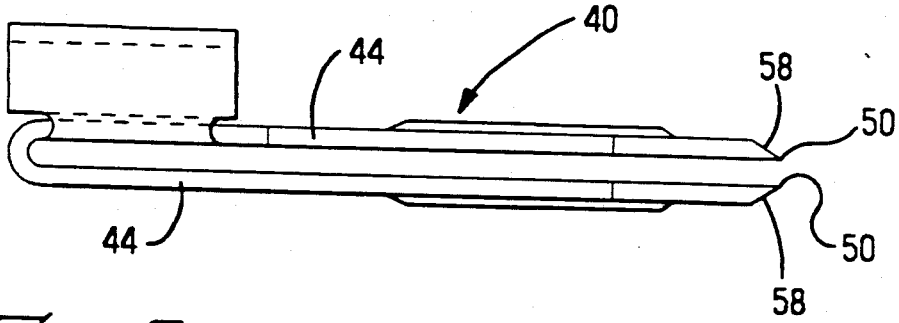
Figure 7:
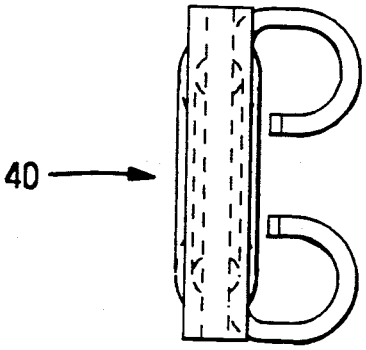
Figure 8:
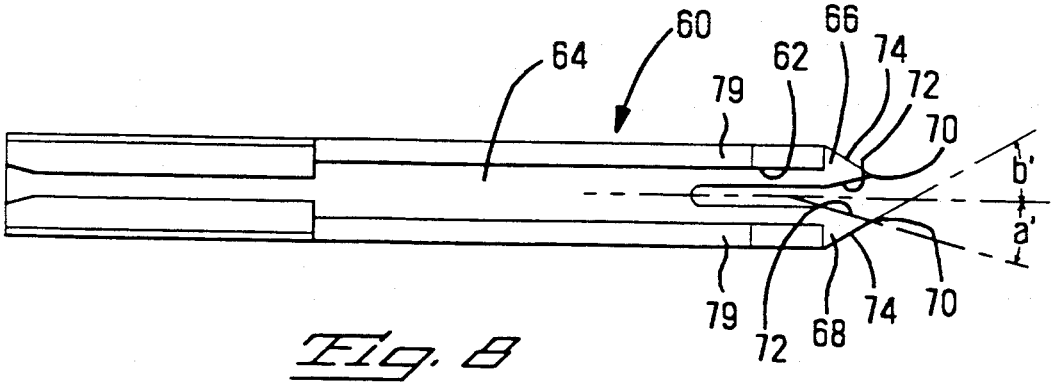
FIGS. 8–10 are views of a relatively smaller signal insulation displacement terminal also embodying the preferred embodiment of this invention, where
Figure 9:
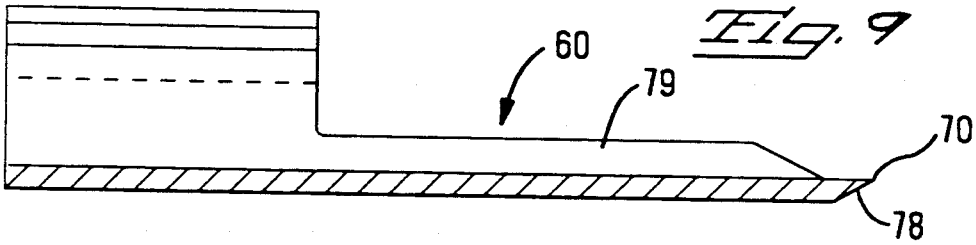
Figure 10:
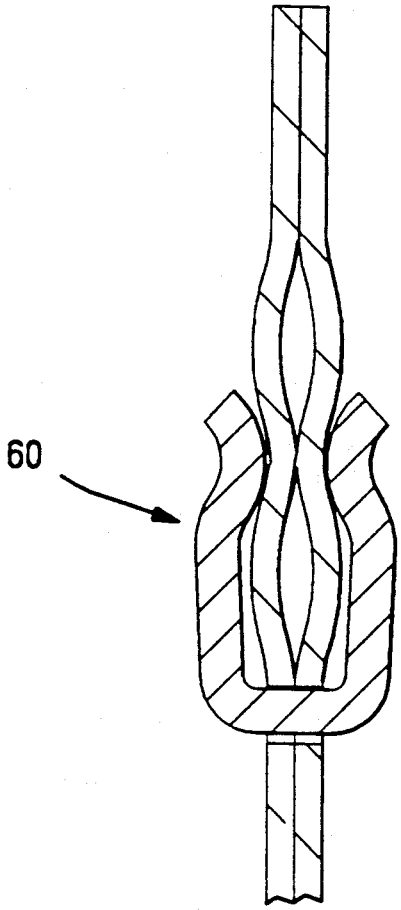
Figure 11:
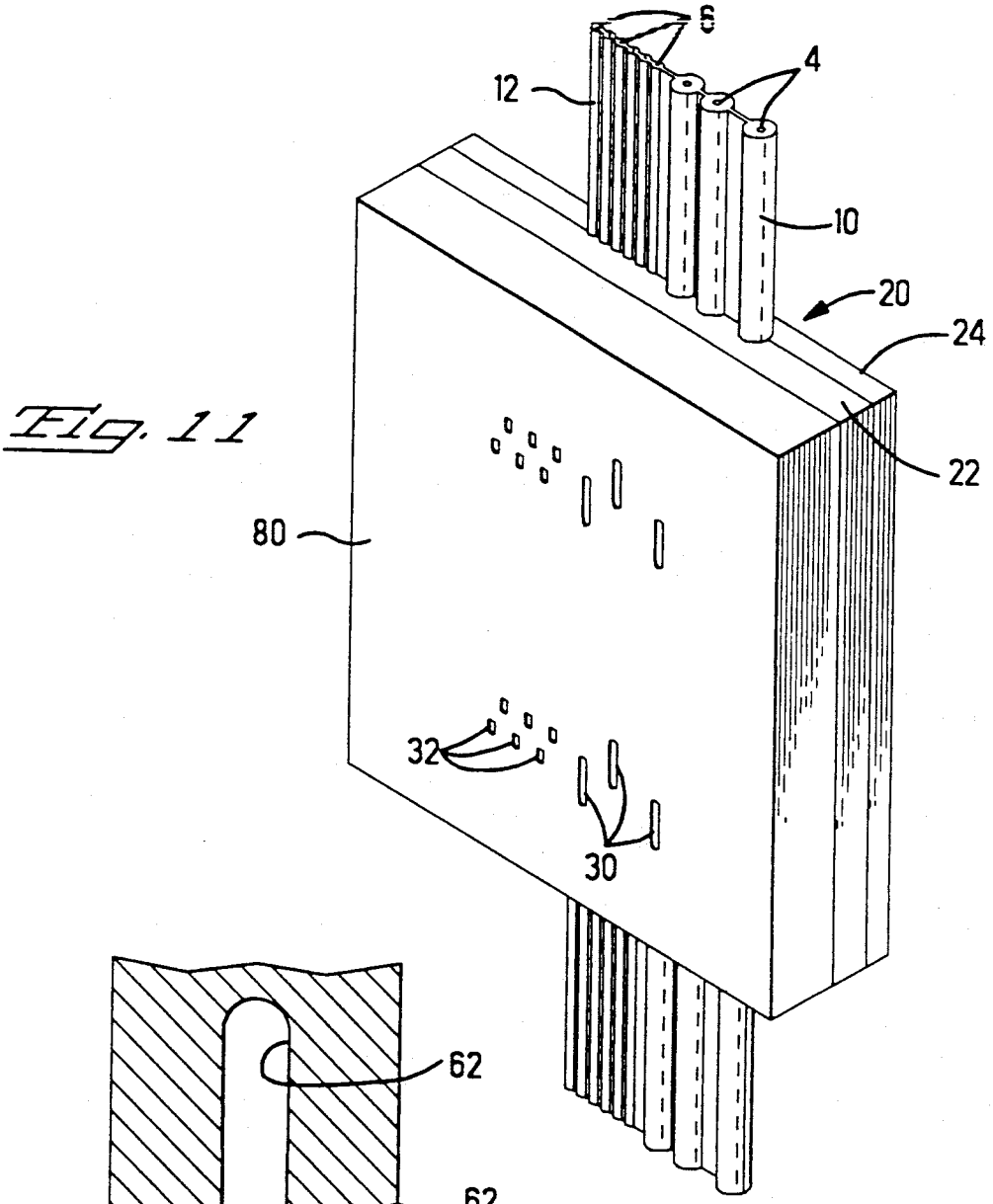
FIG. 11 is a view of an assembled cable tap comprising the electrical connector assembly of the preferred embodiment of this invention.

In the preferred embodiment of this invention as shown in FIGS. 5–7, insulation displacement terminals 40 are dimensioned for establishing an insulation displacement contact with the relatively larger wires 4. As shown in FIGS. 8–10, insulation displacement terminals 60 are configured for establishing an insulation displacement contact with the relatively smaller wires 6 and flat cables 2. Each of these terminals 40 and 60 are positioned within an insulative housing 80 which is attachable to the cable clamp 20. The relatively larger terminal 40 has an insulation displacement slot 42 extending inwardly from one end of a terminal slotted plate 44. Two arms 46 are defined within the slotted plate 44 on either side of the insulation displacement slot 42. Slot 42 has side edges parallel to the centerline of the slot for establishing insulation displacement termination to a wire or conductor inserted laterally of its axis into the slot. The two arms 46 and 48 on either side of slot 42 have sharp points 50. The two sharp points 50 on either side of the slot 42 are spaced apart by a distance which is less than the diameter of the grooves 26 in clamp 20 so that the sharp points 50 are positioned to engage the cylindrical crests 10 of the cable 2 which is positioned within the clamp 20. Further, such spacing between points 50 is preferably from 1 to 1.5 times the diameter of the wire or conductor. As illustrated in FIG. 5, for example, inner sloping edges 52 extend from the sharp points 50 on arms 46 and 48 inwardly towards the slot 42. An outer sloping edge 54 extends from sharp point 50 to the side edges 56 of the terminal. The sharp points 50 are formed by the intersection of the first edge 52 with the second edge 54 and by a bevelled surface 58 on one side of the terminal.

The second terminal 60 (FIG. 8) differs from the first terminal 40. The second terminal 60 is intended for use in establishing insulation displacement termination to the relatively smaller wires 6, and the width of the second terminal 60 must be less than the width of the first terminal 40 because the width of the second terminal 60 can be no greater than the centerline spacing between the relatively smaller wires 6. Furthermore, the width of the second terminal 60 can be no greater than the width of the apertures 32 formed in the cable clamp 20. Signal terminals 60 each have an insulation displacement slot 62 extending inwardly from one end thereof. This insulation displacement slot is located within a second terminal slotted plate 64. The length of slotted plate 64 is the same as the length of the two parallel slotted plates 44 in the first terminal because the first and second terminal must make contact with the wires 4 and 6 at the same time since the cable is flat and wires 4 and 6 would be located in a common plane when terminated. As with the first terminal 40, the second terminal 60 has two arms 66, 68 within the slotted plate 64 on opposite sides of the insulation displacement slots 62 Like the first terminal, the arms 66, 68 are insertable through apertures 32 in the same manner as the arms 46 and 48 are insertable through the apertures 30 and clamp 20. Each arm 66 and 68 has a sharp point 70. The sharp point 70 on either side of the insulation displacement slot 62 are spaced apart by a distance which is less than the diameter of the smaller grooves 8 so that the sharp point 70 engages a cylindrical crest 12 surrounding the relatively smaller wires 6. As with terminal 40, terminal 60 has an inner sloping edge 72 and an outer sloping edge 74. The inner sloping edge extends from the sharp point 70 and intersects the insulation displacement slot 62. The outer sloping edge 74 extends from the sharp point 70 and intersects the side edges 76 of the second terminal 60. Sharp points 70 are defined by the intersection of the inner and outer sloping edges 72 and 74 and a bevelled surface 78 on one side of the slotted plate 64.

The first terminal 40 has two parallel slotted plates 44 and each of these slotted plates is embossed to provide additional strength. The second terminal 60 must of necessity be much smaller and this terminal is provided with channel sections 79 which extend transversely relative to the plane containing the slot 62 to increase the beam stiffness of the terminal.

Figure 12:
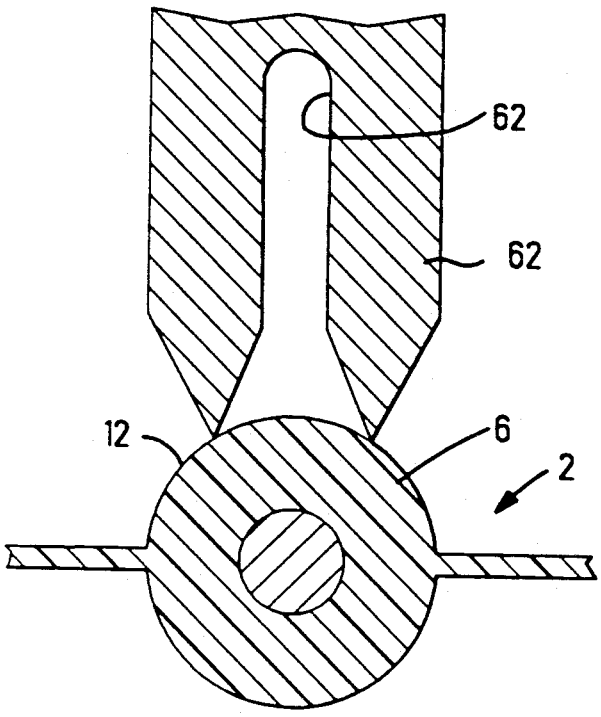
FIG. 12 is a fragmentary view of a preferred terminal showing the preferred relative dimensions of the terminal and the wires.

The sharp points 50 and 70 on both of terminals 40 and 60 are positioned to engage the cylindrical crests of the flat cable. In the preferred embodiment of this invention sharp points 50 or 70 on opposite sides of insulation displacement slots 42 and 46 respectively are spaced apart by a distance which is approximately equal to approximately 1 to 1.5 times the diameter of the wires to be terminated as shown substantially in FIG. 12. In prior art flat cable insulation displacement terminal these sharp points engage the web between adjacent wires, or at best along the lower portion of the crests near the web. In contrast, the contacts of this invention are designed to engage the cylindrical crests surrounding the wire along the upper portion thereof. Considering the insulated wire as a compass, the points 50 would engage the insulation between the compass readings NW to NE. In this manner the resultant force tending to spread the arms on either side of slots 42 and 46 apart is reduced because forces act on both the inner sloping edges and the outer sloping edges of both terminals from the initial engagement of the sharp points 50 and 70 with the wire insulation. In both the first and second terminals 40 and 60, the slope on the outer edge 54, 74, as denoted by angles b and b' (See FIGS. 5 and 8), is at least twice the slope on the inner edge 52, 72, as denoted by angles a and a', when the slope is determined relative to the centerline of the insulation displacement slots 42 and 62. In the preferred embodiment of the first terminal 40, the slope of the outer edge is b'=30° whereas the slope on the inner edge is a'=15°. In the preferred embodiment of the second terminal 60, the slope of the outer edge is b'=34° whereas the slope of the inner edge is a'=15°. As depicted herein, the sharp insulation penetrating points 50 and 70 are therefore spaced apart so as to initially engage the narrower sector of the corresponding cylindrical crest 10 and 12 at a relatively steep angle upper half of the insulation crest, to initiate penetration of the common insulative web in such a manner as to reduce the tendency of the slots 42, 62 to become enlarged prior to engagement with their respective wires. This tendency is especially significant with respect to the second terminal 60.

Although this invention is especially adapted for use with hybrid cables containing wires of different sizes, it should be understood that this invention can be employed with other cable configurations and even with discrete wires. Furthermore, the inventive concept of engaging the curved exterior of insulation surrounding wires is not limited to the specific embodiments of the first and second terminals depicted herein. Therefore, the claims appended hereto are directed not merely to the preferred embodiment of the invention, but to configurations which may be obvious to one of ordinary skill in the art in light of the preferred embodiments as disclosed herein. The applicability of this invention to other embodiments is clearly indicated by the difference between the first and second terminals 40 and 60 on which this invention is employed.

Having described this invention in its most preferred embodiment, exemplary dimensions for a hybrid cable, i.e. one containing data wires and power conductors, may be found in the following table.

TABLE

| Wire Gauge diameter (inches) | Overall Thickness w/ insulation | IDC Contact Points Spacing (Inches) | IDC Contact Slot Width (Inches) |
|---|---|---|---|
| 24 / .020" | .060" | .031" | .0126" |
| 14 / .064" | .180" | .100" | .046" |
| 12 / .081" | .180" | .100" | .046" |

In the above examples, the "points" spacing, relative to the conductor diameter is about 1.2 to about 1.5 times such diameter, whereas the IDC contact slot width is between about 55% to about 80% of the wire diameter, thus assuring good electrical contact with such wire.

We claim:

1. An insulation displacement terminal having a slot formed between two members, the slot having side edges parallel to the centerline of the slot for establishing an insulation displacement termination to a wire encased in insulation and inserted laterally of its axis into the slot, each said member having a sharp point defined by converging inner and outer sloped edges at one end for penetrating the insulation surrounding said wire, where the lateral distance between said points is between 1 and 1.5 times the diameter of said wire and the slope of the inner sloping edge relative to the centerline of the slot is less than the slope of the outer sloping edge relative to the centerline of the slot, whereby the resultant force, normal to the centerline of the slot, tending to open the slot as the inner and outer sloping edges engage insulation surrounding the wire is reduced so that the tendency of the two members to spread apart as a result of engagement of the insulation with the inner and outer sloping edges is lessened whereby the slot edges make a more reliable contact with a wire upon insertion therein.

2. The terminal of claim 1 wherein an edge section of each member extends transversely relative to a plane containing the slot to increase the stiffness of the terminal.

3. The terminal of claim 1 wherein the slope of the outer edge is at least twice the slope of the inner edge.

4. An electrical connector assembly for establishing insulation displacement contacts with a plurality of wires in a flat cable having insulation surrounding the wires to form cylindrical crests, concentric with the wires, on the outer surface of the cable, the electrical connector assembly comprising:

a clamp having cylindrical grooves conforming to the shape of the cylindrical crests on the outer surface of the cable and apertures intersecting each groove; and terminals each having an insulation displacement slot between two arms the arms being insertable through the apertures, each arm having a sharp point on its end, where the two sharp points are spaced apart by a distance which is less than the diameter of said grooves while being approximately equal to one and one half times the diameter of the wires, so that the sharp points engage the cylindrical crests of a cable position within the clamp.

5. The electrical connector assembly of claim 4 wherein each arm has inclined knife edges on each side of the sharp point for penetrating the insulation forming the cylindrical crests on the cable.

6. An electrical connector assembly for establishing insulation displacement terminations to wires in a cable, the cable having a plurality of relative larger wires and a plurality of relative smaller wires positioned within a common insulative web, the centerline spacing between adjacent relatively smaller wires being less than the centerline spacing between adjacent relatively larger wires, cylindrical crests, concentric with the wires, being formed on the outer surface of the common insulative web, the electrical connector assembly including:

a cable clamp for holding the cable in a flat configuration with the centerlines of all of the wires being in the same place for insulation displacement termination:

an insulation housing attachable to the cable clamp;

first and second terminals positioned within the insulative housing, each terminal having a slotted plate extending from the insulative housing, the width of the second terminal slotted plate being less than the width of the first terminal slotted plate so that the second terminal slotted plates can fit between the more closely spaced relatively smaller wires, the length of each slotted plate being substantially equal, the second terminal slotted plate therefore being more flexible than the first slotted plate, the second slotted plate having sharp insulation piercing points on either side of a slot extending inwardly from the end of the second terminal slotted plate defined by inner and outer sloping edges the sharp insulation piercing points being spaced apart a distance of about 1 to 1.5 times the diameter of the wire to be terminated therebetween, so as to initially engage the corresponding cylindrical crest at a relatively steep angle to initiate penetration of the common insulative web in such a manner as to reduce the tendency of the slot in the second slotted plate to become enlarged prior to engagement with the relatively smaller second wires.

* * * * *